US005909814A

United States Patent [19]

Arikawa

[11] Patent Number: 5,909,814

[45] Date of Patent: Jun. 8, 1999

[54] PAPER CURRENCY RECEIVING AND DISPENSING MACHINE

[75] Inventor: Junichi Arikawa, Kawaguchi, Japan

[73] Assignee: Laurel Bank Machines Co., Ltd., Tokyo, Japan

[21] Appl. No.: 08/928,695

[22] Filed: Sep. 12, 1997

[30] Foreign Application Priority Data

Sep. 18, 1996 [JP] Japan ..... 8-246654
Sep. 10, 1997 [JP] Japan ..... 9-245440

[51] Int. Cl.[6] ..... B07C 5/00; B07C 5/34

[52] U.S. Cl. ..... 209/534; 270/58.18

[58] Field of Search ..... 209/534; 271/3.01, 271/3.08, 303, 305; 270/58.18

[56] References Cited

U.S. PATENT DOCUMENTS 4,511,794 4/1985 Imamichi ..... 209/534
4,625,870 12/1986 Nao et al. ..... 209/534
4,697,071 9/1987 Hiraoka et al. ..... 209/534
4,726,474 2/1988 Arikawa et al. .
4,787,518 11/1988 Yuge et al. ..... 209/534
4,883,183 11/1989 Kimura et al. ..... 209/534
4,890,824 1/1990 Uchida et al. ..... 209/3.01
5,000,322 3/1991 Goi ..... 209/534
5,555,983 9/1996 Yamagishi ..... 209/534

*Primary Examiner*—William E. Terrell
*Assistant Examiner*—Joe Dillon, Jr.
*Attorney, Agent, or Firm*—Frishauf, Holtz, Goodman, Langer & Chick, P.C.

[57] ABSTRACT

A paper currency (hereinafter "bill") receiving and dispensing machine includes a bill receiving opening in which the bills are deposited, temporary storing boxes for the bills each of which is adapted to temporarily store plural denominations of bills which are deposited in the bill receiving opening and to discharge the stored bills therefrom, and a plurality of bill storing boxes adapted to store the bills discharged from the temporary storing boxes, and to discharge the stored bills therefrom. The bill storing boxes are provided in respective denominations. The machine further includes a first transport passage for communicating the bill receiving opening with the temporary storing boxes such that the bills are moved between the bill receiving opening and the temporary storing boxes, and a second transport passage for communicating the temporary storing boxes with the bill storing boxes such that the bills are moved between the temporary storing boxes and the bill storing boxes. The second transport passage is independently disposed from the first transport passage.

10 Claims, 2 Drawing Sheets

PAPER CURRENCY RECEIVING AND DISPENSING MACHINE

BACKGROUND OF THE INVENTION

1. Field of the Invention

The present invention relates to an apparatus for receiving and dispensing bills, in particular to an apparatus for receiving and dispensing bills which can efficiently receive the paper money (i.e., bills).

2. Description of the Related Art

A conventional bill receiving and dispensing machine is known which discriminates whether received bills are acceptable or not and the denominations of the bills, and in which the paper monies (hereinafter referred to as bills) are stored in a temporary storing box and then the bills are stored in bill storing boxes by bill denomination. In the conventional bill receiving and dispensing machine, after a teller or a customer confirms the amount of the bills received and inputs a bill deposit instruction signal, the bills are fed from the bill temporary storing box to the bill storing boxes.

However, in the conventional machine, the next bills can not be received until all of the bills in the temporary storing box have been fed to the bill storing boxes. Therefore, the conventional machine can not efficiently receive the bills.

Further, when the number of the one denomination of bill in the bill storing box exceeds a predetermined value, the bill storing box can not store any more bills. Therefore, the teller or the customer has to stop the machine and remove the bills. Then the customer has to deposit the bills again. Thus, the machine can not efficiently receive the bills.

SUMMARY OF THE INVENTION

It is therefore an object of the present invention to provide an apparatus for receiving and dispensing bills which can efficiently receive the bills This and other objects are achieved according to the present invention by providing an apparatus for receiving and dispensing bills comprising, a bill receiving opening in which the bills are deposited, at least two bill temporary storing boxes adapted to temporary store the bills which are deposited in the bill receiving opening and to take out the stored bills, a plurality of bill storing boxes adapted to store the bills taken out from the bill temporary storing boxes and to take out the stored bills, the bill storing boxes being provided for respective denominations, a first transport passage for connecting the bill receiving opening with the bill temporary storing boxes such that the bills are fed between the bill receiving opening and the bill temporary storing boxes, and a second transport passage for connecting the bill temporary storing boxes with the bill storing boxes such that the bills are fed between the bill temporary storing boxes and the bill storing boxes, the second transport passage being disposed independently from the first transport passage.

In the present invention, at least two bill temporary storing boxes are adapted to temporary store the bills which are deposited in the bill receiving opening and to take out the stored bills, the first transport passage for connecting the bill receiving opening with the bill temporary storing boxes and the second transport passage for connecting the bill temporary storing boxes with the bill storing boxes are disposed independently. Therefore, while the bills stored in one of the two bill temporary storing boxes are fed to the plurality of the bill storing boxes, the bills deposited in the bill receiving opening can be efficiently stored in the other of the two bill temporary storing boxes.

According to a preferred embodiment of the present invention, the apparatus further comprises a transport passage branching off from the second transport passage and connecting with the first transport passage. In this embodiment, even if the number of the bills in one of the plurality of the bill storing boxes becomes too large and therefore the bill storing box can not store the bills any more, the bills to be stored in the one of the bill storing boxes are fed to one of the two bill temporary storing boxes which is empty through the passage branching off the second transport passage and connecting with the first transport passage. Therefore, the bills can continue to be received and the machine can efficiently receive the bills.

According to another preferred embodiment of the present invention, the second transport passage connects with a bill dispensing opening.

According to another preferred embodiment of the present invention, the first transport passage and the second transport passage respectively include bill discrimination means for discriminating the bills.

The above and other objects and features of the present invention will be apparent from the following description by taking reference with accompanying drawings employed for preferred embodiments of the present invention.

DESCRIPTION OF THE PREFERRED EMBODIMENTS

The present invention will now be explained with reference to preferred embodiments and the drawings.

Figure 1:
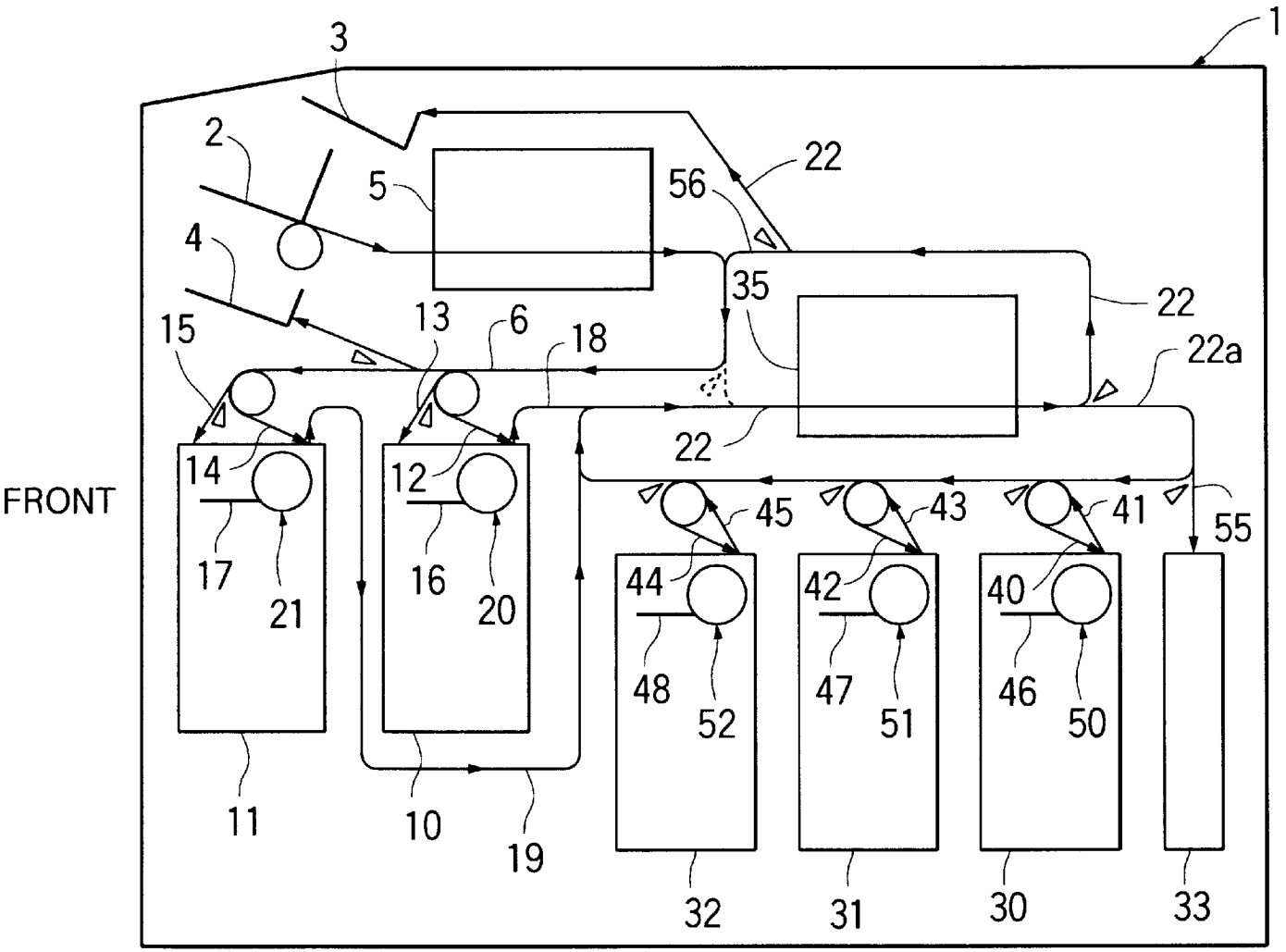
FIG. 1 is a schematic side view showing a bill receiving and dispensing machine in accordance with a preferred embodiment of the present invention.

FIG. 1 is a schematic side view showing a bill receiving and dispensing machine in accordance with a preferred embodiment of the present invention.

As shown in FIG. 1, the bill receiving and dispensing machine 1 comprises a bill receiving opening 2 for receiving bills, a bill dispensing opening 3 for dispensing bills, and a bill returning opening 4 for returning bills which are discriminated to be unacceptable. All of the openings 2, 3 and 4 are disposed at the front side of the machine 1. The bill receiving and dispensing machine 1 further comprises a bill discrimination section 5 for discriminating the bills one by one which are received by the bill receiving opening 2 and then taken out from the bill receiving opening 2 by a known taking out means (not shown). The bill discrimination section 5 is adapted to discriminate whether or not the bills are acceptable. The bill discrimination section 5 is further adapted to discriminate the denominations of bills, the front and rear surfaces of the bills, whether or not two or more bills are completely or partially overlapped (hereinafter called "double feed") and whether or not the bills are obliquely fed (hereinafter called "oblique travel") and further to count the number of bills which are acceptable, when the bill are discriminated to be acceptable. The bills discriminated by the bill discrimination section 5 to be unacceptable, double fed or traveling obliquely are fed to the returning opening 4 and returned to the teller or customer. A first transport passage 6 is disposed to connect the bill receiving opening 2 and the bill discrimination section 5 with the bill returning opening 4.

A first bill temporary storing box 10 and a second bill temporary storing box 11 are provided detachably on the lower portion of the front side of the machine 1. The first bill temporary storing box 10 is connected to the first transport passage 6 through both a transport passage 12 and a transport passage 13 branching off from the passage 12, and the second bill temporary storing box 11 is connected to the first transport passage 6 through both a transport passage 14 and a transport passage 15 branching off from the passage 14. The transport passages 13 and 15 turn the bills over and feed them into the first and second temporary storing boxes 10 and 11. The first and second temporary storing boxes 10 and 11 have the same structure and are respectively provided therein with bill placement plates 16 and 17 which move up and down and on which the fed bills are placed. The first temporary storing box 10 is provided with a bill receiving and taking out mechanism 20 which receives the bills from the transport passages 12 and 13 in the first box 10 and takes out the bills stored in the first box 10 and feed them to a transport passage 18. Similarly, the second temporary storing box 11 is provided with a bill receiving and taking out mechanism 21 which receives the bills in the second box 11 from the transport passages 14 and 15 and takes out the bills stored in the second box 11 and feeds them to a transport passage 19. The transport passages 12, 13, 14 and 15 and the bill receiving and taking out mechanisms 20 and 21 are disclosed in U.S. Pat. No. 5,553,840. The transport passages 18 and 19 are connected to a second transport passage 22 for dispensing the bills to the bill dispensing opening 3.

Three bill storing boxes 30, 31 and 32, each for storing bills of one denomination after the bills have been classified into the respective denominations, are provided detachably on the lower portion of the rear side of the machine 1, and an unacceptable bill receiving box 33 is provided behind the box 30.

The second transport passage 22 is connected to the bill dispensing opening 3 through a bill discrimination section 35 which discriminates the denominations of bills, the double feed of bills and the oblique travel of the bills and counts the number of bills. The bill discrimination section 35, the unacceptable bill receiving box 33 and the bill storing boxes 30, 31 and 32 are connected by a loop passage 22*a*.

The bill storing boxes 30, 31 and 32 are respectively connected to the loop passage 22*a* of the second transport passage 22 through transport passages 40 and 41, transport passages 42 and 43 and transport passages 44 and 45. The bill storing boxes 30, 31 and 32 are respectively provided therein with bill placement plates 46, 47 and 48 which move up and down and on which the fed bills are placed. The bill storing boxes 30, 31 and 32 are respectively provided with bill receiving and taking out mechanisms 50, 51 and 52 which receive and take out the bills. The bill placement plates 46, 47 and 48 and driving mechanisms thereof have the same structures as those of the bill placement plates 16 and 17 of the first and second boxes 10 and 11 and their driving mechanisms. The structures of the bill receiving and taking out mechanisms 50, 51 and 52 are well known.

A transport passage 55 branches off from the loop passage 22*a* of the second transport passage 22 and is connected to the unacceptable bill receiving box 33, and a transport passage 56 branches off from the downstream portion of the second transport passage 22 and connects with the first transport passage 6.

The bill receiving and dispensing machine 1 is further provided with a pair of supporting units (not shown) which are slidable. The first and second bill temporary storing boxes 10 and 11 are supported by one of the supporting units, and the bill storing boxes 30, 31 and 32 are supported by the other of the supporting units. Accordingly, the first and second bill temporary storing boxes 10 and 11 can be picked up by the one of the supporting units being drawn out, and the bill storing boxes 30, 31 and 32 can be picked up by the other of the supporting units being drawn out.

Figure 2:
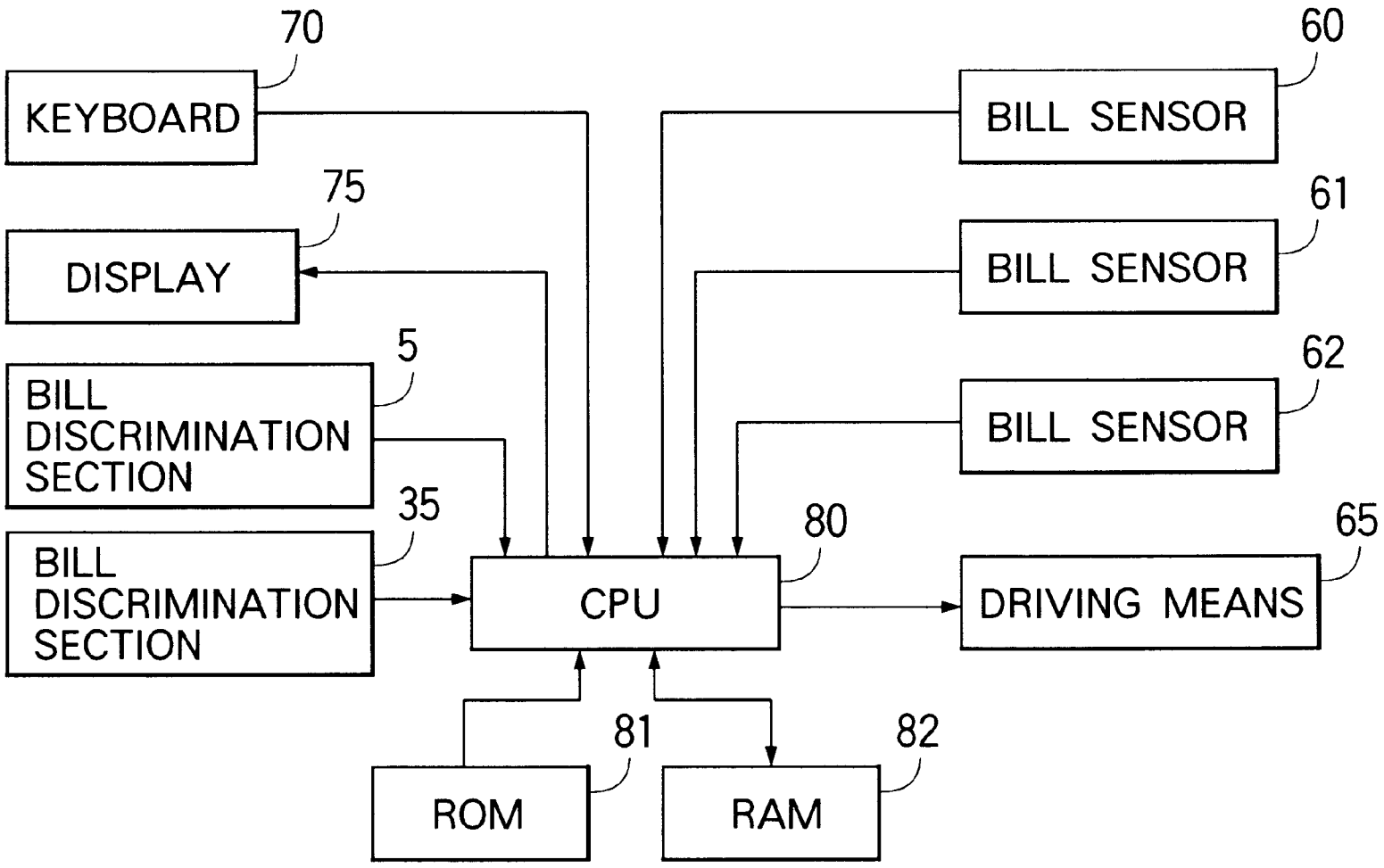
FIG. 2 is a block diagram showing a sensing section, a driving section, an input section, a display section and a control section of the bill receiving and dispensing machine in accordance with the preferred embodiment of the present invention.

FIG. 2 is a block diagram showing a sensing section, a driving section, an input section, a display section and a control section of the bill receiving and dispensing machine in accordance with the preferred embodiment.

The sensing section of the bill receiving and dispensing machine 1 includes the bill discrimination sections 5 and 35 and bill sensors 60, 61 and 62. The bill sensors 60, 61 and 62 respectively sense whether or not numbers of the bills stored in the bill storing boxes 30, 31 and 32 have reached respective predetermined values, by detecting the locations or heights of the bill placement plates 46, 47 and 48.

The driving section of the machine 1 includes a driving means 65 having driving rollers (not shown) disposed in the first and second transport passages 6 and 22, and a plurality of motors (not shown) disposed so as to drive the bill receiving and taking out mechanisms 20, 21, 50, 51 and 52 and the like.

The input section of the machine 1 includes a keyboard 70 which tellers and customers operate and through which various instruction signals are input. The display section of the machine 1 includes a display 75 which displays the results of counted numbers of the bill and the like.

The control section of the machine 1 includes a CPU 80, a ROM 81 storing a program for controlling the machine 1 and the like, and a RAM 82 for storing various data. The bill discrimination signals generated by the bill discrimination sections 5 and 35 and the detection signals generated by the bill sensors 60, 61 and 62 are input to the CPU 80. The CPU 80 controls the machine 1 based on these input signals and the instruction signals input through the keyboard 70, by using the control program stored in the ROM 81.

How the bills are received and dispensed in the bill receiving and dispensing machine 1 in accordance with the embodiment explained above will be explained below.

When the machine 1 is put in service, the first and second boxes 10 and 11 and the unacceptable bill receiving box 33 are all empty, and the bill storing boxes 30, 31 and 32 store predetermined numbers of the respective bills. The bills can be stored in the boxes 30, 31 and 32 after they are drawn out by the supporting unit of the boxes 30, 31 and 32. Alternatively the bills may be stored in the boxes by the bills being fed to the boxes 30, 31 and 32 through the bill receiving opening 2, the first transport passage 6, the first or second bill box 10 or 11 and the second transport passage 22, which will be explained below.

When a bill receiving signal is input through the keyboard 70 and the bills are deposited in the bill receiving opening 2 by a teller or a customer, the CPU 80 outputs a driving signal to the driving means 65.

As a result, the bills are taken out to the first transport passage 6, and the bill discrimination section 5 discriminates whether or not the bills are acceptable. When the bills are discriminated to be acceptable, the bill discrimination section 5 further discriminates the denominations of the bills, front surfaces and rear surfaces of the bills, double feed and oblique travel of the bills, and counts the amounts of the bills in the respective denominations.

The amounts of the bills in the respective denominations counted by the bill discrimination section 5 are output to the CPU 80 and are stored in the RAM 82.

The bills which are discriminated to be acceptable by the bill discrimination section 5 are received in one of the first box 10 or the second box 11 which is empty. Since both of the first and second boxes 10 and 11 are empty when the machine 1 is put in service, the case where the acceptable bills are received in the first box 10 will be explained below.

The bills which are discriminated to be acceptable and to have the front surfaces thereof facing upward by the bill discrimination section 5 are fed to the first temporary storing box 10 through the first transport passage 6 and the transport passage 12. On the other hand, the bill which are discriminated to be acceptable and to have the front surfaces thereof facing downward by the bill discrimination section 5, are fed to the first temporary storing box 10 through the first transport passage 6 and the transport passage 13, in which the bills are turned over so that the front surfaces thereof face upward. The bills fed to the first box 10 are placed on the bill placement plate 16, which is located at the upper portion by a motor (not shown), with the front surfaces of the bills facing upward. As is well known, the bill placement plate 16 is moved downward by the motor as the bills are placed on the plate 16.

On the contrary, the bills which are discriminated by the bill discrimination section 5 to be double fed or traveling obliquely are returned through the first transport passage 6 to the bill returning opening 4 and finally returned to the teller or the customer.

When all of the bills deposited in the bill receiving opening 2 have been stored in the first box 10, the CPU 80 operates the display 75 to display the total amount of the bills counted by the bill discrimination section 5 and stored in the RAM 82. Thus, since all of the bills which are discriminated to be unacceptable, double fed or traveling obliquely are returned to the bill returning opening 4 and finally returned to the teller or the customer, and all of the bills stored in the first box 10 are counted by the bill discrimination section 5, the correct total amount of the bills is stored in the RAM 82 and displayed on the display 75.

Next, when the teller or the customer confirms the amount of the bills displayed on the display 75 and inputs a deposit instruction through the keyboard 70, the CPU 80 outputs a driving signal to the driving means 65 and the driving means 65 drives the bill receiving and taking out mechanisms 20 so that the bills stored in the first box 10 are taken out one by one to the second transport passage 22 through the transport passage 18, unless where some bills are present in the second transport passage 22.

The denomination, the double feed and the oblique travel of the bills taken out to the second transport passage 22 are discriminated and the amount of the bills are counted in the respective denominations by the bill discrimination section 35. The amounts of the bills in the respective denominations counted by the bill discrimination section 35 are output to the CPU 80 and are stored in the RAM 82.

The bills which are discriminated to be double fed or traveling obliquely by the bill discrimination section 35 are received in the unacceptable bill receiving box 33 through the transport passage 55.

On the other hand, the bills which are discriminated to be normal and being fed with no trouble, are sent to the loop passage 22*a* of the second transport passage 22 and then received and stored in one of the bill storing boxes 30, 31 and 32 based on denomination discriminated by the bill discrimination section 35. Thus, since all of the bills stored in the boxes 30, 31 and 32 are counted by the bill discrimination section 35, the correct amounts of the bills are stored in the RAM 82.

The CPU 80 further calculates the amount of the bills stored in the box 33 by subtracting the total amounts of the bills stored in the boxes 30, 31 and 32 counted by the bill discrimination section 35 from the amount of the bills stored in the first box 10, and stores the amount of the bills in the box 33 in the RAM 82. Thus, the amount of the bills in the unacceptable bill receiving box 33 stored in the RAM are also correct.

According to the preferred embodiment explained above, the feeding of the bills from the first box 10 to the boxes 30, 31 and 32 does not require feeding of the bills onto the first transport passage 6. Therefore, even when the bills have not yet been taken out from the first box 10, the bills deposited in the bill receiving opening 2 can be efficiently stored in the second box 11 by feeding then onto the first transport passage 6. Thus, the deposited bills are efficiently received by the machine 1.

On the other hand, when the teller or the customer does not accept the displayed amount of the bills and inputs a no deposit signal through the keyboard 70 based on the amount of the bills, the CPU 80 outputs a drive signal to the driving means 65. In response, the bill taking out mechanism 20 takes out the bills one by one stored in the first box 10 to the second transport passage 22 through the passage 18. The bills taken out to the passage 22 are fed to the bill dispensing opening 3 through the bill discrimination section 35, and finally are received by the teller or the customer. Thereafter, the CPU 80 clears the amount counted by the section 5 and stored in the RAM 82.

Next, when the teller or the customer inputs a dispense signal through the keyboard 70, the CPU 70 calculates the numbers of the respective denominations of the bills to be dispensed from the boxes 30, 31 and 32 and outputs a drive signal to the driving means 65 based on the input amount. In response, the bill taking out mechanisms 50, 51 and 52 successively take out the calculated numbers of the respective denominations of the bills from the boxes 30, 31 and 32 to the loop passage 22*a* of the second transport passage 22.

The bills taken out to the loop passage 22*a* are fed the bill discrimination section 35 in which the denomination, the double feed and oblique travel of the bills are discriminated.

The bills discriminated as being double fed or traveling obliquely are fed to the passage 55 and stored in the unacceptable bill receiving box 33. The CPU 80 calculates the amount of the bills discriminated as being double fed which of the boxes 30, 31 and 32 the bills are taken out from. At this time, the CPU 80 calculates the amount of the double fed bills stored in the box 33 as double the amount of a bill of the denomination concerned. The CPU 80 further calculates the amount of the bills discriminated as traveling obliquely based on which of the boxes 30, 31 and 32 the bills were taken from. These calculated amounts for the double fed and obliquely traveling bills are respectively stored in the RAM 82. When double feed and/or oblique travel are discriminated by the section 35, the CPU 80 operates the driving means 65 so that one bill of the denomination corresponding that of the bill discriminated as being double fed and/or traveling obliquely is taken out from the corresponding box 30, 31 or 32 to the loop passage 22*a* of the second transport passage 22. At the same time, the CPU 80 calculates the amount of the bills which pass through the section 35 and reach to the bill dispensing opening 3, calculates the total of this amount and the amount of the bills stored in the box 337 obtains the amount of the bills stored in the boxes 30, 31 and 32 by subtracting the sum from the amount of the bills in the boxes 30, 31 and 32 stored in the RAM 82, and finally updates the data stored in the RAM 82. Even if bills discriminated as being double fed and fed into the box 33 are actually three or more bills, the amount of such bills is counted as a double amount as explained above. Thus, the amount of the bills stored in the box 33 is not always the real amount but an estimated amount. Therefore, when double feed is discriminated by the section 35, the amounts of the bills stored in the boxes 30, 31 and 32 are also estimated amounts.

The bills passing through the section 35 with no double feed or oblique travel are fed to the dispensing opening 3 and dispensed to the teller or the customer.

According to the preferred embodiment, bills are dispensed by feeding them from the boxes 30, 31 to the bill dispensing opening 3 through the second transport passage 22. Therefore, when the bills are dispensed, when the bills are received by the bill receiving opening 2 while the bills are being dispensed, the section 5 discriminates and counts the bills and stores the bills in the box 10. Thus, the received bills can be efficiently processed by the machine 1.

Further, the bill receiving and dispensing machine 1 in accordance with the preferred embodiment can continue to receive the bills even when one of the boxes 30, 31 and 30 can not store any more bills because the height of the bills placed on the plate 46, 47 or 48 in the box 31, 32 or 33 becomes greater than a predetermined value.

Namely, when the bill number counting sensor 60, 61 or 62 outputs a detection signal indicating that the height of the bills placed on the plate 46, 47 or 48 in the box 30, 31 or 32 has reached a predetermined value when the bills stored in box 10 are to be fed or are being fed to the box 30, 31 or 32 through the transport passage 18 and the second transport passage 22, the CPU 80 outputs a driving signal to the driving means 65 to cause the bills that were to be stored in the box 30, 31 or 32 associated with the sensor 60, 61 or 62 that output the signal to be fed to the second box 11 through the section 35, unless a bill is present in the first transport passage 6.

The denominations, double feed and oblique travel of the bills are discriminated by the bill discrimination section 35, and the amount of the bills is counted in the respective denominations by the section 35. The bills discriminated as being double fed or traveling obliquely are fed to the box 33 through the passage 55.

The bills not double fed or traveling obliquely are fed to the second box 11 through the passages 22, 56, 6 and 14. The CPU 80 stores in the RAM 82 the amount of the bills counted by the section 35 and stored in the second box 11. Since the section 35 accurately counts the amount of the bills to be stored in the second box 11, the accurate amount is stored in the RAM 82.

The bills other than the bills to be thus stored in the second box 11 are, as explained above, fed to the section 35 in which the numbers of the bills in the respective denominations are counted, and are fed to the corresponding box 30, 31 or 32 based on their denominations. The The CPU 80 calculates the amount of the bills stored in the box 33 by subtracting the amount of the bills counted by the section 35 and stored in the boxes 30, 31, 32 and 11 from the amount of the bills which were previously stored in the box 10, and the RAM 82 stores the amount of the bills in the box 33. The calculated amount of the bills in the box 33 is accurate since such amount is obtained based on the amounts which were actually counted by the sections 5 and 35.

When the CPU 80 has determined, based on the data in the RAM 82 regarding the bills in the boxes 30, 31 and 32 stored in the RAM 82, that no bills received through the bill receiving opening 2 are present in the first box 10 or the second box 11 and the number of the bills in one of the boxes 30, 31 and 32 has fallen below a predetermined value, the boxes 30, 31 or 32 is replenished with the bills of the corresponding denomination.

Namely, supplementary bills are supplied into the first or second box 10 or 11, whichever is empty, after the supporting unit of the first and second boxes 10 and 11 has been drawn out. Both the first and second boxes 10 and 11 are empty unless bills to be stored in the boxes 30, 31 and 32 were stored in one of them because the number of the bills in one of the boxes 30, 31 and 32 reached to the predetermined value. The supplementary bills can therefore be supplied into either the first or second box 10 or 11.

When replenishing the bills, the teller inputs the amounts of the supplementary bills in the respective denominations through the keyboard 70, and the CPU 80 stores the amounts in the RAM 82.

After the supplementary bills have been supplied into the one of the first and second boxes 10 and 11, the supporting unit is set to the machine 1. Thereafter, the bills are taken out and stored in the one of the boxes 30, 31 and 32 in the same manner as in the case that the bills received in the bill receiving opening 2 and stored in the box 10 are taken out and stored in the boxes 30, 31 and 32.

Namely, the bills discriminated as being double fed or traveling obliquely by the section 35 are stored in the box 33 through the passage 55. The CPU 80 calculates the amount of the bills stored in the one of the boxes 30, 31 and 32 based on the discrimination signal from the section 35, and the RAM 82 stores the amount of the bills. After all of the bills stored in either of the boxes 10 or 11 have been taken out, the CPU 80 calculates the amount of the bills stored in the box 33 by subtracting the amount of the bills stored in the one of the boxes 30, 31 and 32 from the amount of the supplementary bills previously input through the keyboard 70, and the calculated amount is stored in the RAM 82. The calculated amount of the bills in the box 33 is accurate since the section 35 actually counts the amount of the bills stored in the one of the boxes 30, 31 and 32.

The bill receiving and dispensing machine 1 in accordance with the preferred embodiment can calculate the amounts of the bills remaining in the respective boxes 30, 31 and 32 and display such amounts on the display 75 when the machine 1 is taken out of service at the end of the day.

Namely, after the machine 1 has been taken out of service at the end of the day, the teller inputs a remaining bill calculation signal through the keyboard 70. In response, the CPU 80 outputs a drive signal to the driving means 65 for feeding the bills stored in one of the boxes 30, 31 and 32 through the loop passage 22*a* of the second transport passage 22 and the passages 22, 56 and 6 to the one of the boxes 10 and 11 which is empty. At this time, the section 35 discriminates only double feed and oblique travel. When double feed and/or oblique travel are discriminated, the CPU 80 operates the driving means 65 to feed such discriminated bills to the box 33 through the passage 55, but does not count the amount of the bills. As explained above, one of the boxes 10 and 11 is necessarily empty when the service is over, although other of the boxes 10 and 11 may store the bills fed from one of the boxes 30, 31 and 32 in which bills can not be stored. Since the CPU 80 can recognize which one of the boxes 10 and 11 is empty, all of the bills stored in one of the boxes 30, 31 and 32 can be stored in one or the other of the boxes 10 and 11. When both of the boxes 10 and 11 are empty, the CPU 80 selects one of them and stores the bills fed from one of the boxes 30, 31 and 32 therein. Storing of the bills in the first box 10 will be explained below.

The CPU 80 then outputs a drive signal instructing the driving means 65 to feed the bills stored in the first box 10 to the bill discrimination section 35 through the passages 18 and 22. The section 35 discriminates double feed and oblique travel of the bills and counts the bills. When double feed and/or oblique travel are discriminated, the bills discriminated as being double fed and/or traveling obliquely are fed to the box 33 through the passage 55 based on the detection signal from the section 35. The bills not double feed or traveling obliquely are fed from the section 35 through the loop passage 22*a* to the one of the boxes 30, 31 and 32 in which the bills were previously stored. The CPU 80 stores in the RAM 82 the amount of the bills stored in the one of the boxes 30, 31 and 32 and displays the amount of the bills on the display 75 based on the data input from the section 35. Thus, the amount of the bills displayed on the display 75 is accurate since the section 35 counts the amount of the bills actually passing through the section 35 and stored in the box 30, 31 or 32. When the teller inputs an instruction signal through the keyboard 70 requesting display of the amount of the bills stored in the box 30, 31 or 32 which was previously stored in the RAM 82, the CPU 80 operates the display 75 to display the previously stored amount of the bills in the box 30, 31 and 32. As a result, the teller can compare the newly counted amount of the bills with the previously stored amount of the bills.

In a similar manner, the CPU 80 successively operates the machine 1 so that the bills stored in another of the boxes 30, 31 and 32 are fed to the first box 10, the discrimination section 35 counts the amount of the bills, the bills are returned to the box 30, 31 or 32, and finally the display 75 displays the amount of the bills stored in the one of the boxes 30, 31 and 32.

In the preferred embodiment, as explained above, the bills are stored in the first box 10 or the second box 11 when the height of the bills in one of the boxes 30, 31 and 32 has reached the predetermined value so that the box can not store any more bills. Therefore, when the machine 1 is taken out of service, bills may remain in one of the first box 10 and the second box 11. When the bills remain in one of the first and second boxes 10 and 11 at the end of the service day, therefore, the machine 1 in accordance with the preferred embodiment calculates the amount of the bills remaining in the one of the first and second boxes 10 and 11 and displays this amount on the display 75. This will be explained for the case in which the bills remain in the second box 11.

The CPU 80 outputs a drive signal to the driving means 65 instructing it to feed he bills stored in the second box 11 to the bill discrimination section 35 through the passages 19 and 22. The section 35 discriminates the denomination, double feed and oblique travel of the bills and counts the bills. When double feed and/or oblique travel are discriminated, the bills discriminated as being double fed and/or traveling obliquely are fed to the box 33 through the passage 55. The bills without such double feed nor oblique travel are fed from the section 35 through the second transport passage 22, the first transport passage 6 and the passage 12 to the first box 10.

The CPU 80 stores in the RAM 82 the amount of the bills stored in the first box 10 and displays this amount of the bills on the display 75 based on the data input from the section 35. Thus, the amount of the bills displayed on the display 75 is accurate since the section 35 counts the amount of the bills actually passing through the section 35 and stored in the first box 10.

Thereafter, the teller draws out the supporting unit from the machine 1, collects the bills remaining in the first box 10 and the unacceptable bill receiving box 33, and counts the amount of the bills. Then, when the teller inputs an instruction signal through the keyboard 70, the CPU 80 operates the display 75 to display the amounts of the bills in the boxes 10 and 33 previously stored in the RAM 82. As a result, the teller can compare the newly counted amount of the bills with the previously stored amount of the bills.

Thus, the teller can confirm the amount of the bills remaining in the boxes 30, 31 and 32 of the machine 1 at the end of the service day and make preparations for next day's service.

Further, in accordance with the preferred embodiment, the bill receiving and dispensing machine 1 can leave predetermined numbers of the bills in the respective boxes 30, 31 and 32 at the end of the service day. In this case, when the teller inputs an instruction signal through keyboard 70, the CPU 80 outputs a drive signal instructing the driving means 65 to feed the bills stored in one of the boxes 30, 31 and 32 to the one of the boxes 10 and 11 which is empty through the loop passage 22*a* of the second transport passage 22 and the passages 22, 56 and 6. At this time, the section 35 discriminates only double feed and oblique travel. When double feed and/or oblique travel are discriminated, the CPU 80 operates the driving means 65 so that such discriminated bills are fed to the box 33 through the passage 55, but does not count the amount of the bills. Storing of the bills in the first box 10 will be explained below.

The CPU 80 then outputs a drive signal instructing the driving means 65 to feed the bills stored in the first box 10 to the bill discrimination section 35 through the passages 18 and 22. The section 35 discriminates double feed and oblique travel of the bills and counts the bills. When double feed and/or oblique travel are discriminated, the bills discriminated as being double fed and/or traveling obliquely are fed to the box 33 through the passage 55 based on the detection signal from the section 35. The bills without such double feed nor oblique travel are fed from the section 35 through the loop passage 22*a* to the one of the boxes 30, 31 and 32 in which the bills were previously stored. When the number of the bills stored in the one of the boxes 30, 31 and 32 has reached the predetermined value, the CPU 80 operates the driving means 65 based on the data input from the section 35 so that the bills passing through the section 35 are fed to the second box 11 through the passages 22, 56, 6 and 14. At this time, the amount of the bills stored in the second box 11 is counted by the section 35, and the CPU 80 stores this amount of the bills in the RAM 82.

In a similar manner, the CPU 80 successively operates the machine 1 so that the bills stored in another one of the boxes 30, 31 and 32 are fed to the first box 10, and only the predetermined number of the bills are returned to the boxes 30, 31 or 32. Thus, the machine 1 can leave the predetermined numbers of the bills in the respective boxes 30, 31 and 32 at the end of the service day.

In this case, if the numbers of the bills left in the respective boxes 30, 31 and 32 are less than the predetermined numbers to be left at the end of the service day, the teller makes up for the shortage of the respective denominations of the bills, and operates the keyboard 70. The replenishment of the bills can be carried out as explained above.

Thus, the amounts of the bills stored in the boxes 30, 31 and 32 and the first and second boxes 10 and 11 are accurately calculated and stored in the RAM 82 at the end of the service day. Further, the amounts of the bills stored in the boxes 30, 31 and 32 of the machine 1 at the start of the service day are known. Therefore, by subtracting the amount of the bills received and dispensed by the machine 1 after the start of service and the amount of the bills remaining in the boxes 30, 31 and 32 and the boxes 10 and 11 at the end of service, which amounts are stored in the RAM 82, from the amount of the bills stored in the machine 1 at the start of service, the amount of the bills left in the unacceptable bill receiving box 33 can be accurately calculated. As a result, at the end of the service, the teller can compare the actual amount of the bills collected from the box 33 with the calculated amount of the bills.

According to the embodiment of the present invention, the bill receiving and dispensing machine 1 includes the first bill temporary storing box 10 and the second bill temporary storing box 11, and the bills received in the bill receiving opening 2 are fed to the first and second boxes 10 and 11 through the first transport passage 6. Further, the bills stored in the first box 10 or the second box 11 are fed to the bill storing boxes 30, 31 and 32 through the second transport passage 22. Since the first transport passage 6 is disposed independently from the second transport passage 22, the first box 10 or the second box 11 can newly accept the bills which are later deposited in the receiving opening 2, even before all of the bills stored in the box 10 or 11 have been fed to the bill storing boxes 30, 31 and 32. Therefore, the machine 1 can efficiently receive the bills.

Further, according to the embodiment of the present invention, the first transport passage 6 through which the bills received in the bill receiving opening 2 are fed to the first box 10 or the second box 11 is disposed independently from the second transport passage 22 through which the bills in the boxes 30, 31 and are fed to the bill dispensing opening 3. Therefore, the machine 1 can store the bills received in the bill receiving opening 2 in the first box 10 or the second box 11 while the machine 1 is dispensing the bills in the boxes 30, 31 and 32. As a result, the machine 1 can efficiently receive and dispense the bills.

Moreover, according to the embodiment of the present invention, when the number of the bills stored in one of the boxes 30, 31 and 30 becomes too large and therefore the one of the boxes 30, 31 and 32 can not store any more bills, the bills to be stored in the box 30, 31 or 32 can be stored in the first box 10 or the second box 11. Therefore, even if the number of the bills stored in one of the boxes 30, 31 and 30 becomes too large, the machine 1 does not need to stop the bill receiving operation, and therefore the machine 1 can efficiently receive the bills.

Further, according to the embodiment of the present invention, even if the number of the bills stored in one of the boxes 30, 31 and 32 becomes too large and then the bills to be stored in the box 30, 31 or 31 are stored in one of the first box 10 and the second box 11, the machine 1 can accurately confirm the amounts of the bills left in the respective boxes 30, 31 and 32 by using the other of the first box 10 and the second box 11 at the end of the service day.

Still further, according the embodiment of the present invention, at the end of the service day, the bills left in the boxes 30, 31 and 32 are once stored in one of the first box 10 and the second box 11, and thereafter only the predetermined numbers of the bills are returned to the boxes 30, 31 and 32 and the numbers of the bills exceeding the predetermined numbers are stored in the other one of the first box 10 and the second box 11. As a result, the machine 1 can leave only the predetermined numbers of the bills in the boxes 30, 31 and 32.

In the above mentioned embodiment, when the supplementary bills are supplied into the machine 1, the supporting unit is drawn out from the machine 1 and then the bills are supplied into the first box 10 and the second box 11. However, according to another embodiment of the present invention, when the supplementary bills are supplied into the machine 1, the bills to be supplied can be deposited into the bill receiving opening 2 and fed to the first box 10 or the second box 11 and further fed to the boxes 30, 31 and 32. In this embodiment, since the bills are counted by the bill discrimination section 5, the replenishment amount of the bills does not need to be input through the keyboard 70.

In the above mentioned embodiment, based on the data stored in the RAM 82, it is determined whether or not the bills in the boxes 30, 31 and 32 need to be replenished. However, according to still another embodiment of the present invention, sensors are disposed in the boxes 30, 31 and 32, and whether or not the bills in the boxes 30, 31 and 32 need to be replenished is determined by using the detection values of the sensors.

In the above mentioned embodiment, the bill number sensors 60, 61 and 62 detect the condition that the respective boxes 30, 31 and 32 can not store any more bills. However, according to still another embodiment of the present invention, the condition that the respective boxes 30, 31 and 32 can not store any more bills can be determined by using the data stored in the RAM 82.

In the above mentioned embodiment, when double feed and/or oblique travel of the bills are discriminated during the replenishment of the bills, the bills discriminated as being double fed and/or traveling obliquely are fed into the unacceptable bill receiving box 33. However, according to still another embodiment of the present invention, such bills are returned to the dispensing opening 3.

While the present invention has been illustrated by means of several preferred embodiments, one of ordinary skill in the art will recognize that modifications and improvements can be made while remaining within the spirit and scope of the invention. The scope of the invention is determined solely by the appended claims.

What is claimed is:

1. An apparatus for receiving and dispensing bills of plural denominations comprising:

a bill receiving opening in which the bills are deposited;

at least two temporary storing boxes for the bills each of which is adapted to temporarily store the bills of plural denominations which are deposited in the bill receiving opening and to discharge the stored bills therefrom;

a plurality of bill storing boxes adapted to store the bills discharged from the temporary storing boxes and to discharge the stored bills therefrom, each of the plurality of bill storing boxes being adapted to store a respective one of the plural denominations of bills;

a first transport passage, operatively communicating the bill receiving opening with the at least two temporary storing boxes, the first transport passage including first transport means for moving the bills between the bill receiving opening and the temporary storing boxes;

a second transport passage, operatively communicating the at least two temporary storing boxes with the bill storing boxes, the second transport passage including second transport means for moving the bills between the at least two temporary storing boxes and the bill storing boxes, the second transport passage being independently disposed from the first transport passage; and a first bill discrimination means operatively positioned relative to the second transport passage for discriminating the plural denominations of the bills discharged from the at least two temporary storing boxes, comprising a second transport passage selective delivery means for sorting said plural denominations into each of said plurality of bill storing boxes independent of activity of said first transport passage.

2. An apparatus for receiving and dispensing bills according to claim 1, further comprising a second bill discrimination means operatively positioned relative to the first transport passage for discriminating the plural denominations of bills deposited in the bill receiving opening.

3. An apparatus for receiving and dispensing bills according to claim 1, further comprising a bill dispensing opening operatively coupled to said second transport passage for dispensing bills from the apparatus.

4. An apparatus for receiving and dispensing bills according to claim 3, further comprising a second bill discrimination means operatively positioned relative to the first transport passage for discriminating the plural denominations of bills deposited in the bill receiving opening.

5. An apparatus for receiving and dispensing bills according to claim 1, wherein the apparatus further comprises a transport passage interposed between the second transport passage and the first transport passage for operatively coupling the first and second transport passages.

6. An apparatus for receiving and dispensing bills according to claim 5, further comprising a bill dispensing opening in communication with said second transport passage for dispensing bills from the apparatus.

7. An apparatus for receiving and dispensing bills according to claim 5, further comprising a second bill discrimination means operatively positioned relative to the first transport passage for discriminating the plural denominations of bills deposited in the bill receiving opening.

8. An apparatus for receiving and dispensing bills of plural denominations comprising:

a bill receiving opening in which the bills are deposited;

at least two temporary storing boxes for the bills each of which is adapted to temporarily store the plural denominations of bills which are deposited in the bill receiving opening and to discharge the stored bills therefrom;

a plurality of bill storing boxes adapted to store the bills discharged from the temporary storing boxes and to discharge the stored bills therefrom, each of the plurality of bill storing boxes being adapted to store a respective one of the plural denominations of bills;

a first transport passage, operatively communicating the bill receiving opening with the at least two temporary storing boxes, the first transport passage including first transport means for moving the bills between the bill receiving opening and the temporary storing boxes; and a second transport passage, operatively communicating the at least two temporary storing boxes with the bill storing boxes, the second transport passage including second movement means for moving the bills between the at least two temporary storing boxes and the bill storing boxes, the second transport passage being independently disposed from the first transport passage; a selective delivery means for sorting said plural denominations into each of said plurality of bill storing boxes independent of activity of said first transport passage.

9. An apparatus for receiving and dispensing bills of plural denominations according to claim 8, wherein said at least two temporary storing boxes for the bills operate alternately to store the bills therein.

10. An apparatus for receiving and dispensing bills of plural denominations comprising:

a bill receiving opening in which the bills are deposited;

a temporary storing box for the bills adapted to temporarily store the bills of plural denominations which are deposited in the bill receiving opening and to discharge the stored bills therefrom;

a plurality of bill storing boxes adapted to store the bills discharged from the temporary storing box and to discharge the stored bills therefrom, each of the plurality of bill storing boxes being adapted to store a respective one of the plural denominations of bills;

a first transport passage, operatively communicating the bill receiving opening with the temporary storing box, the first transport passage including first transport means for moving the bills between the bill receiving opening and the temporary storing box;

a second transport passage, operatively communicating the temporary storing box with the bill storing boxes, the second transport passage including second transport means for moving the bills between the temporary storing box and the bill storing box, the second transport passage being independently disposed from the first transport passage; and a first bill discrimination means operatively positioned relative to the second transport passage for discriminating the plural denominations of the bills discharged from the temporary storing boxes, comprising a second transport passage selective delivery means for sorting said plural denominations into each of said plurality of bill storing boxes independent of activity of said first transport passage.

* * * * *